US005275306A

United States Patent [19]

Demoss

[11] Patent Number: 5,275,306

[45] Date of Patent: Jan. 4, 1994

[54] LITERATURE DISPENSING MECHANISM

[76] Inventor: Paul Demoss, 5920 Roswell Rd., B-107, Atlanta, Ga. 30328

[21] Appl. No.: 951,094

[22] Filed: Sep. 25, 1992

[51] Int. Cl.[5] ..... B65H 1/08

[52] U.S. Cl. ..... 221/231; 221/255; 221/282

[58] Field of Search ..... 221/231, 255, 257, 282, 221/284, 228, 277; 271/34, 37

[56] References Cited

U.S. PATENT DOCUMENTS 1,918,460 7/1933 Eccardt ..... 221/231
4,919,250 4/1990 Olson et al. ..... 221/282

FOREIGN PATENT DOCUMENTS 0075093 3/1990 Japan ..... 221/231

*Primary Examiner*—Robert P. Olszewski
*Assistant Examiner*—Kenneth Noland
*Attorney, Agent, or Firm*—Roger A. Marrs

[57] ABSTRACT

A display apparatus is disclosed herein for dispensing a quantity of literature sheets or brochures stored in an ordered stack so that a portion of the uppermost piece of literature is visually displayed. Mechanism is provided for advancing the stack of literature within a housing so that the uppermost piece of literature bears against an advancement mechanism including rollers which advances the uppermost piece of literature so as to be partially exposed externally of a dispensing slot whereby a user may readily grasp the exposed portion and withdraw the literature. The stack of literature is carried on a spring-biased platform normally urging the stack upward against the underside of the advancement mechanism. An adjustable tension and system maintains the platform in a centered disposition with respect to the storage housing.

9 Claims, 4 Drawing Sheets

LITERATURE DISPENSING MECHANISM

BACKGROUND OF THE INVENTION

1. Field of the Invention

The present invention relates to the field of literature display and dispensing means, and more particularly, to a novel combined display and dispensing apparatus having a storage compartment for holding a quantity of pieces of literature and which includes an adjustable and controllable means for forcibly urging the stack upward so that the topmost piece of literature is available for viewing and exposing a portion of the literature for dispensement through a slot in the housing by automatic advancement mechanism.

2. Brief Description of the Prior Art

In the past, it has been the conventional practice to distribute literature, such as brochures or information sheets, by placing them in a stack held in a rack, basket or the like. In some instances, wire or plastic racks are employed so that the outside or topmost piece of literature in the stack is available for perusal by potential customers or the like. Should the consumer or interested party desire the literature, the uppermost or outermost piece is lifted from the stack and manually separated from the holder or rack on which the stack is held.

Furthermore, most storage means for the stack of literature hold less than four inches of literature (thus, a problem to keep full) and if the holding means holds more, such as in a large stand, the potential customer must bend over as the stack is depleted in order to manually take a piece of the literature.

Further difficulties and problems are encountered with such conventional holding means for a stack of literature, which stem largely from the fact that the stack is not protected from dirt, gum, trash or other foreign matter which may collect and distort the view of the literature as it is being perused by a potential or interested customer. Often, more than one piece is taken by mistake as when the customer takes one piece, friction between adjacent literature piece faces often causes another piece to leave the stack and thus causes unnecessary waste, or frequently it is difficult for the customer to separate one piece of literature with his or her fingers. Other problems occur since the stack of literature may not be completely balanced, so that a tendency to topple or become completely separated oftentimes occurs. Lack of balance in conventional literature racks also frequently causes literature to become bent, curled and/or otherwise damaged and unsightly.

Therefore, a long-standing need has existed to provide a novel dispenser for holding a large stack of pieces of literature so that the uppermost piece is available for perusal and at the same time the rest of the stack is completely covered, so that dirt and other foreign matter cannot penetrate the stack or obliterate the literature. Thus, it is desirable to have a storage and dispensing means for literature which comprises a combination of an advertising area and literature dispensing apparatus. The ability to hold, protect and dispense a wide range of literature sizes and weights is also of importance in the same display-dispenser apparatus.

SUMMARY OF THE INVENTION

Accordingly, the above problems and difficulties are overcome by the present invention which provides a novel literature display-dispensing apparatus for displaying, releasing and permitting the withdrawal of a single piece of literature or booklet or the like from a stack of literature whereby a storage compartment is provided in a housing that mounts a movable platform supporting the stack of literature pieces. Resilient means are operatively connected between the stationary housing and the movable platform for normally biasing the literature stack in an upward direction under a predetermined pressure so that the uppermost piece of literature is available for withdrawal via a dispensing mechanism by an intended customer or user. Access to the storage compartment is via a hinged lid or cover. A feature of the invention resides in the fact that an advancement mechanism is provided beneath the lid and cooperates with the uppermost piece of literature to effect dispensing.

A literature dispensing pressure must be maintained against the dispensing mechanism to optimize performance which includes resilient means that not only provides the required pressure but which will accommodate the full weight range of the literature. In one form, a double pulley mechanism is employed to reduce extension of spring length and an adjustment means is included for fine resilient means preload adjustment.

Another object of the present invention is to provide a novel dispensing apparatus for holding a stack of literature bearing against the dispensing mechanism under a predetermined range of pressure which includes resilient biasing means for introducing the uppermost sheet of literature under pressure for dispensing through a slot.

Another object of the present invention is to provide a novel means for holding a plurality of literature pieces under pressure against the advancement mechanism in such a fashion that a single piece from the plurality may be dispensed from the apparatus.

A further object of the present invention is to provide an inexpensive and reasonably simple means of advancing a plurality of literature pieces utilizing resilient means to cause the literature to bear against the advancement mechanism under a predetermined pressure so that a single piece may be extracted or dispensed without disturbing the remaining pieces in the stack or plurality.

A further object relates to a combined dispensing and display apparatus for literature, having the ability to hold, protect and dispense a high volume of literature pieces in a single storage unit and further having the ability for automatically advancing the uppermost piece of literature within a range of pressure to a preparatory position, having a portion exposed so as to be readily available for grasping by the user when it is desired to extract the literature from the apparatus.

Still a novel provision resides in utilizing various combinations of springs with a mechanical advantage means, such as a double pulley mechanism, so that a full weight range of various literature pieces can be raised against the advancement mechanism while maintaining a desired pressure against the advancing or dispensing mechanism.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
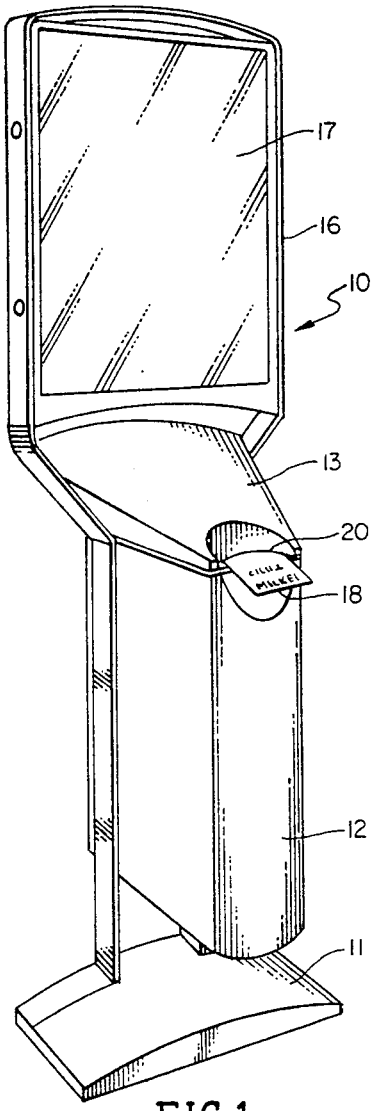
FIG. 1 is a front elevational view of a combined display and dispensing apparatus of the present invention.

Referring to FIG. 1, the novel display stand of the present invention is illustrated in the general direction of arrow 10 which includes a support base 11 having an upright housing 12 defining an interior storage compartment and which terminates at its upper end with a lid or cover 13. It is to be particularly noted that the housing includes a display means or frame 16 having a central window composed of transparent material and indicated by numeral 17. A poster or other graphic material may be held in static display by the frame. An uppermost piece of literature is indicated by numeral 18 which is the topmost piece of literature on a stack within the storage compartment of the housing 12. Only an end portion of the uppermost literature piece 18 is exposed so that removal can be manually made by pulling the piece out through a dispensing slot 20.

Figure 2:
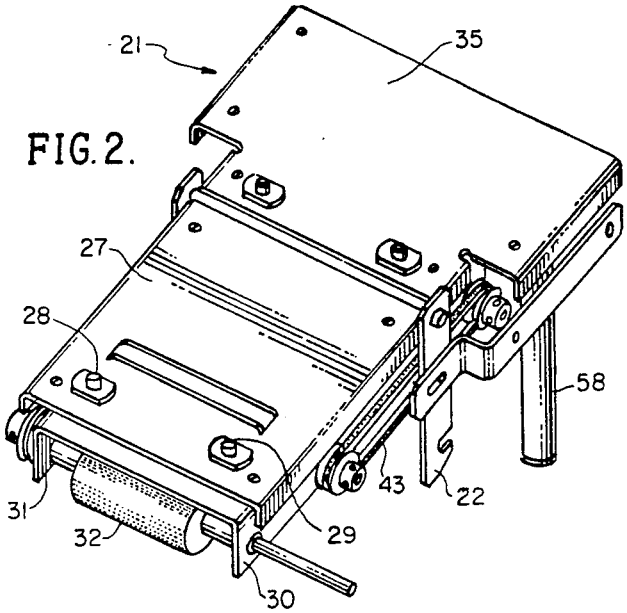
FIG. 2 is an enlarged front perspective view of the automatic dispensing mechanism of the present invention as used in the embodiment shown in FIG. 1.
Figure 3:
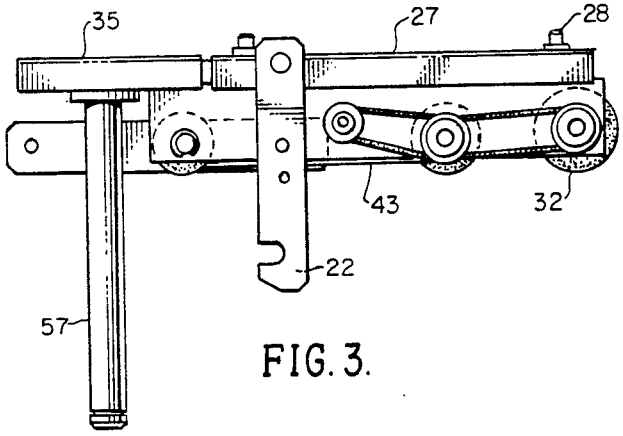
FIG. 3 is a side elevational view of the dispensing mechanism shown in FIG. 2.
Figure 4:
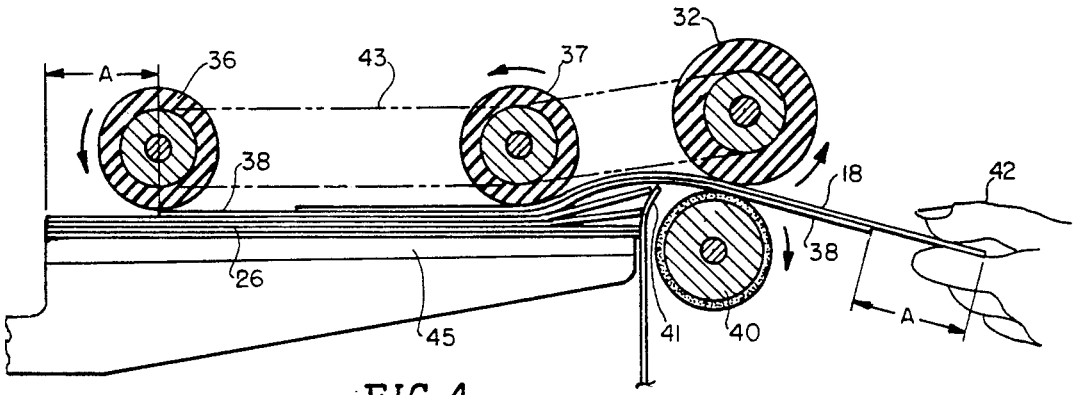
FIG. 4 is an enlarged diagrammatic view of the literature advancement and dispensing mechanism shown in FIG. 2.

A dispensing mechanism 21, shown in FIGS. 2–4, is at a dispensing angle with respect to the longitudinal axis of the elongated housing or cabinet 12. Such an angular disposal of literature permits easier viewing of the literature as it extends outwardly from the dispensing slot, and is the most natural ergonomic angle for the consumer to withdraw a piece of literature.

Figure 5:
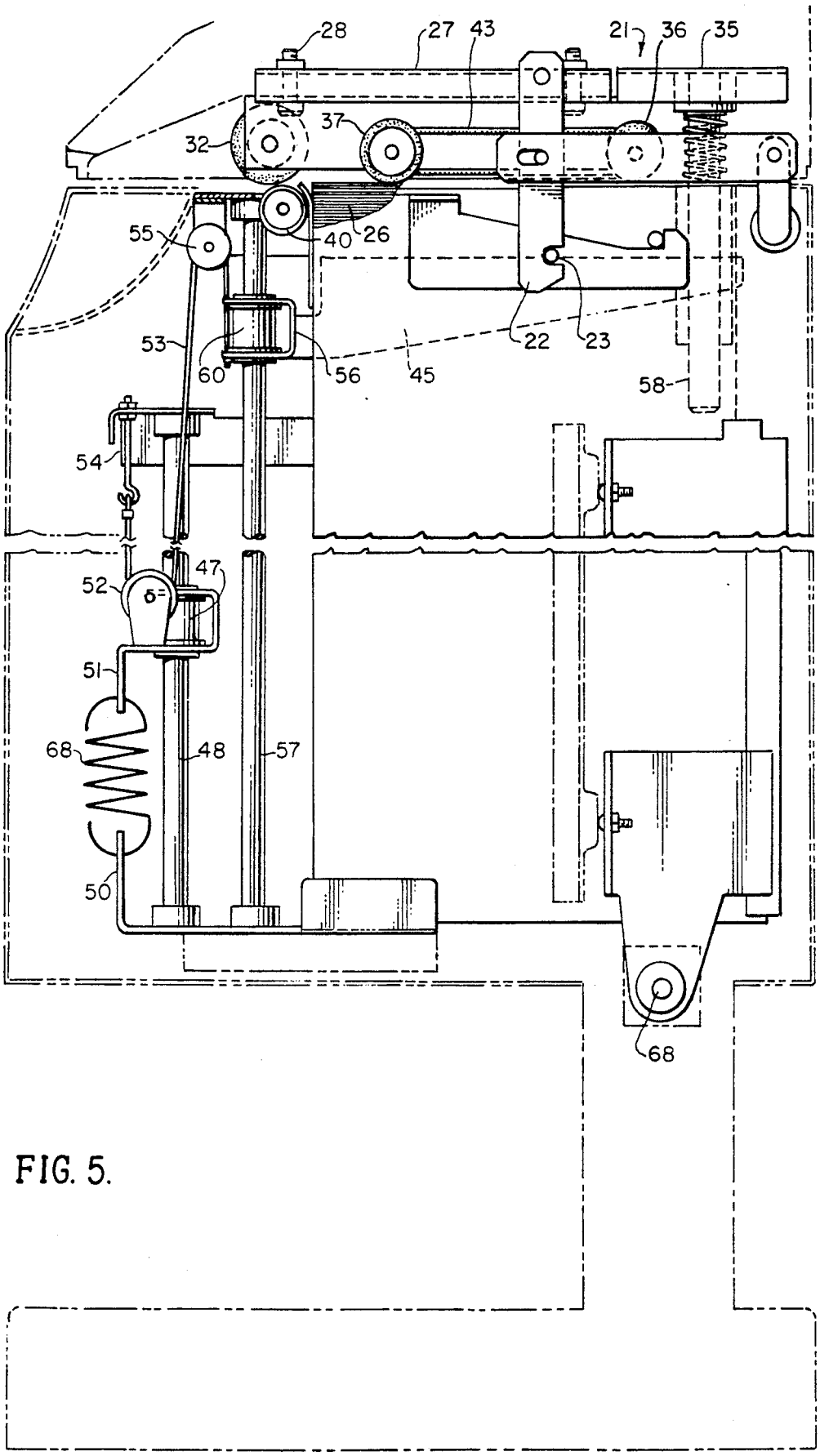
FIG. 5 is a cross-sectional view showing the resilient means for advancing the platform under spring bias so that the literature stack is under pressure against the dispensing mechanism.
Figure 7:
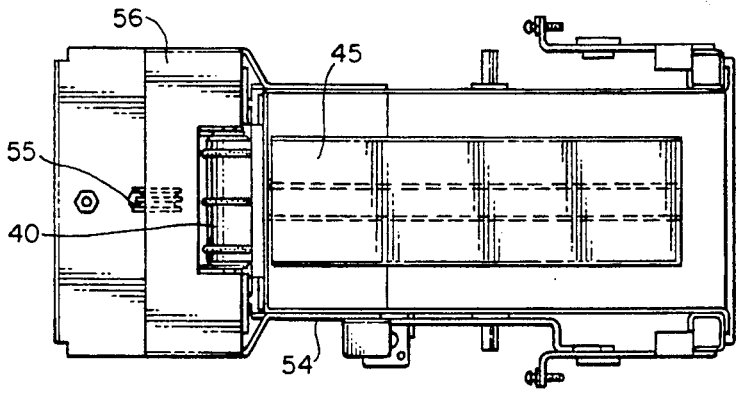
FIG. 7 is a top plan view of the advancement mechanism shown in FIG. 6.
Figure 6:
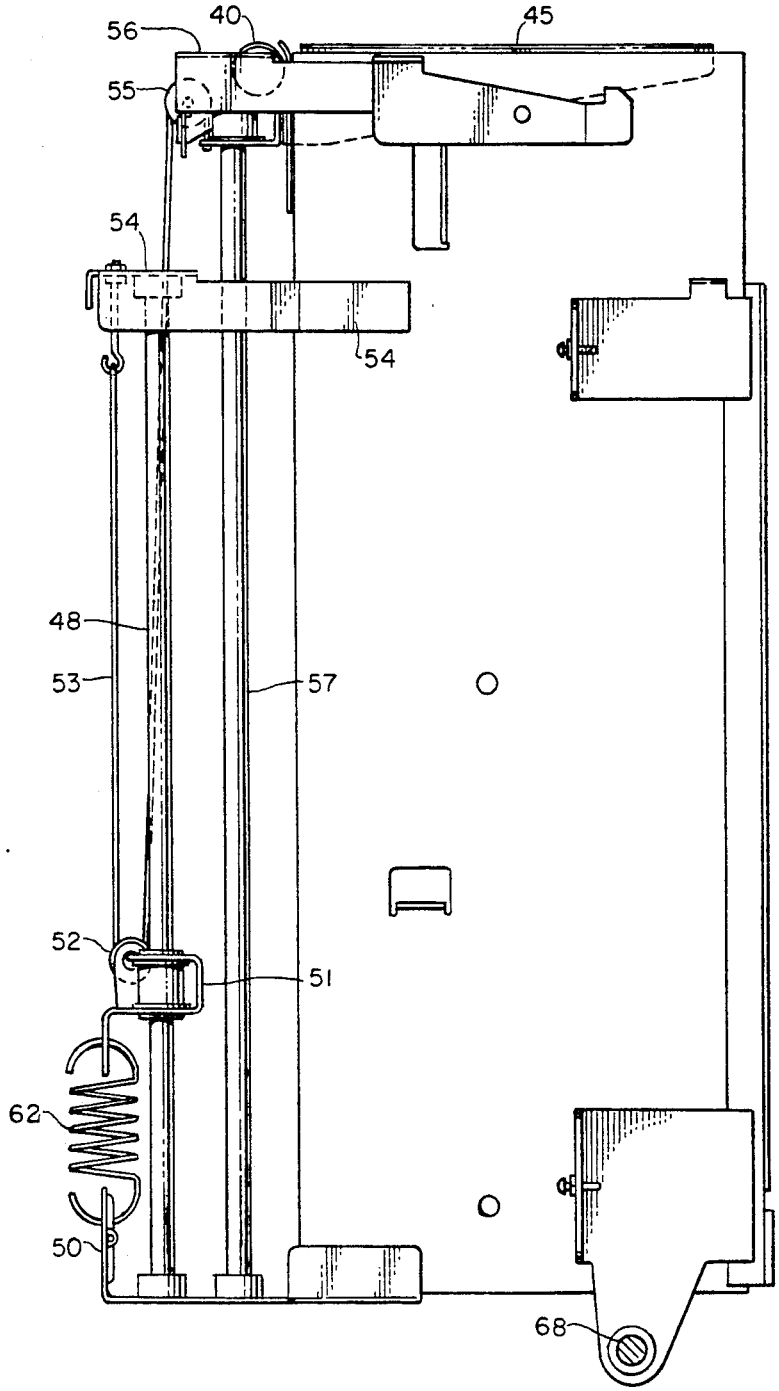
FIG. 6 is a view similar to the view of FIG. 5 showing the biasing spring arrangement in its fully extended position with the platform at topmost position.

The dispensing mechanism is provided with a pivoting latch 22 releasably connectable with a pin 23 shown in FIG. 5 which retains an advancement mechanism unit 24 in place on the housing. A resilient means 25 is employed for biasing a stack of literature 26 upwardly against the underside of the dispensing mechanism 21. The mechanism 21 is carried in a downwardly depending position from a plate 27 by mounting screws 28 and 29. The screws fasten with mechanism side members 30 and 31 which project to terminate in support for a dispensing roller 32. The dispensing mechanism is supported on a pair of spaced-apart rods 33 and 34 and support 35.

Referring now to FIG. 4, a diagrammatic view is presented showing the dispensing mechanism for permitting the dispensing of the topmost piece of literature 18 from the stack of literature held within the container 12. The stack is indicated by numeral 26. The dispensing mechanism includes a pair of counterclockwise rotating rollers 36 and 37, having cushioned peripheries in engaging contact with at least the uppermost two pieces of literature. Roller 37 engages with literature piece 18 while roller 36 engages with the under sheet identified by numeral 38. Roller 32 is raised so that its axis of rotation is slightly higher than the turning axis of rollers 36 and 37 and the periphery of roller 32 engages with the uppermost sheet 18. A support roller 40 is carried on the storage cabinet 12 and rotates in an opposite direction from the counterclockwise rotation of roller 32. The roller 40 is spring-loaded so as to make constant contact with the upper roller or the underside of the sheets 18 or 38. The spring-loading of roller 40 also allows for different thicknesses of literature to pass between the rollers and ensures that traction occurs between literature 18 and roller 32. A feature of the invention resides in providing an adjustable sorting flange or lip 41 against which pieces of literature immediately beneath the first and second sheet in the stack will abut. However, as the first or second sheet in the stack is withdrawn in successive order, the leading edge of the literature sheets will advance over the outward curvature of the lip into a preparatory position for removal from the mechanism. The three rollers 36, 37 and 32 are geared together on a one to one ratio and the spring mechanism 26 advances the stack of literature in a feeding procedure towards the rollers 36 and 37. In this manner, the stack of literature is always ready to be fed and dispensed from the apparatus one piece at a time. Approximately 2½ inches of the topmost piece of literature is available for pullout by the consumer's fingers which are indicated by numeral 42. The pulling of the topmost piece of literature from between the rollers 32 and 40 advances the second or next piece of literature 38 for the taking. It is the frictional relationship between the opposing surfaces of the piece of literature 18 and piece of literature 38, and rollers 36 and 37, which achieves the advancement over the sorting fence or lip 41. Thus, one piece of literature is taken at a time. An activating belt 43 operably connects the rollers together so that as the uppermost piece of literature is withdrawn, causing the rollers to rotate, this movement is transferred to other rollers so as to advance the undermost piece of literature after the topmost has been removed.

Figure 9:
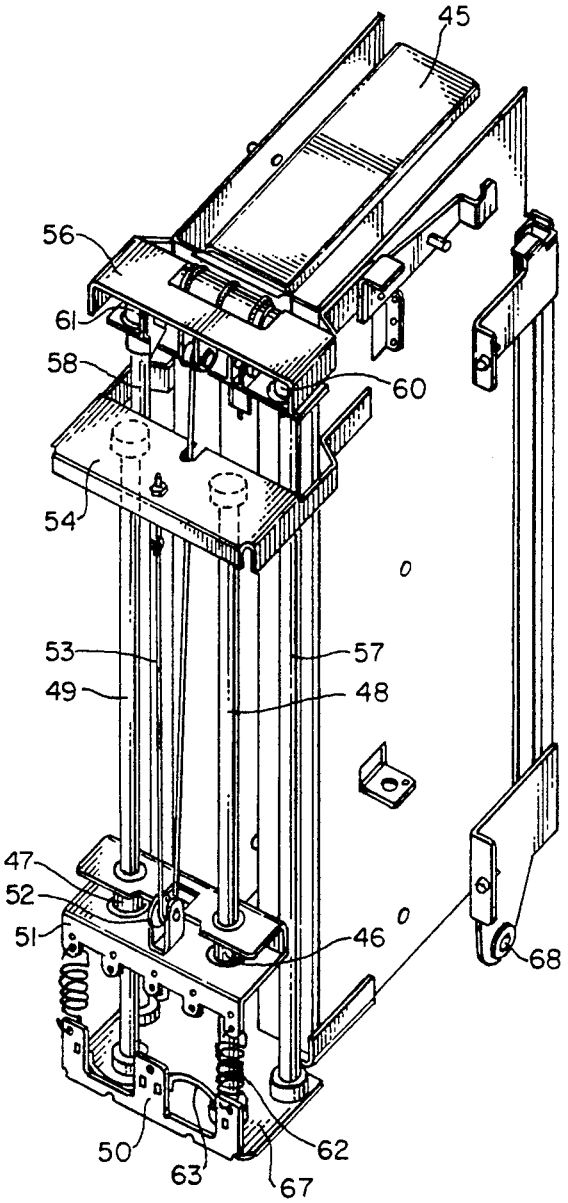
FIG. 9 is a front perspective view of the spring advancement mechanism.

Referring now in detail to FIGS. 5 and 9, it can be seen that the stack of literature 26 is supported on a platform 45 which is movably disposed within the storage chamber or cabinet 12 by means of support bushings 46 and 47 which ride on a pair of stationary tubes 48 and 49. The platform 45 is biased towards the rollers of the dispensing mechanism by a resilient means including a pulley assembly. Such means and assembly include a spring means 25 having one end of the means coupled to a stationary bracket 50 while the opposite end of the means is attached to a traveler 51. The traveler includes a pulley 52 about which a cable 53 is trained wherein one end of the cable is attached to stationary structure as represented by numeral 54 while the opposite end of cable 53 passes over a stationary pulley 55 so that the end connects to a carriage 56 on which the bushings 46 and 47 are mounted. Therefore, it can be seen that the bias of the resilient means urges the platform 45 and the stack of literature 26 upwardly through the cabinet so as to engage with the rollers of the dispensing mechanism.

The platform 45 is carried on a movable carriage 56 supported on a pair of rods 57 and 58 by means of the bushings 60 and 61. Therefore, it can be seen that as the contraction of the resilient means 25 urges the carriage 51 downwardly, the pulley and cable arrangement will translate the downward pull and force of the spring means into an upward biasing of the platform via the moving carriage 56.

Figure 8:
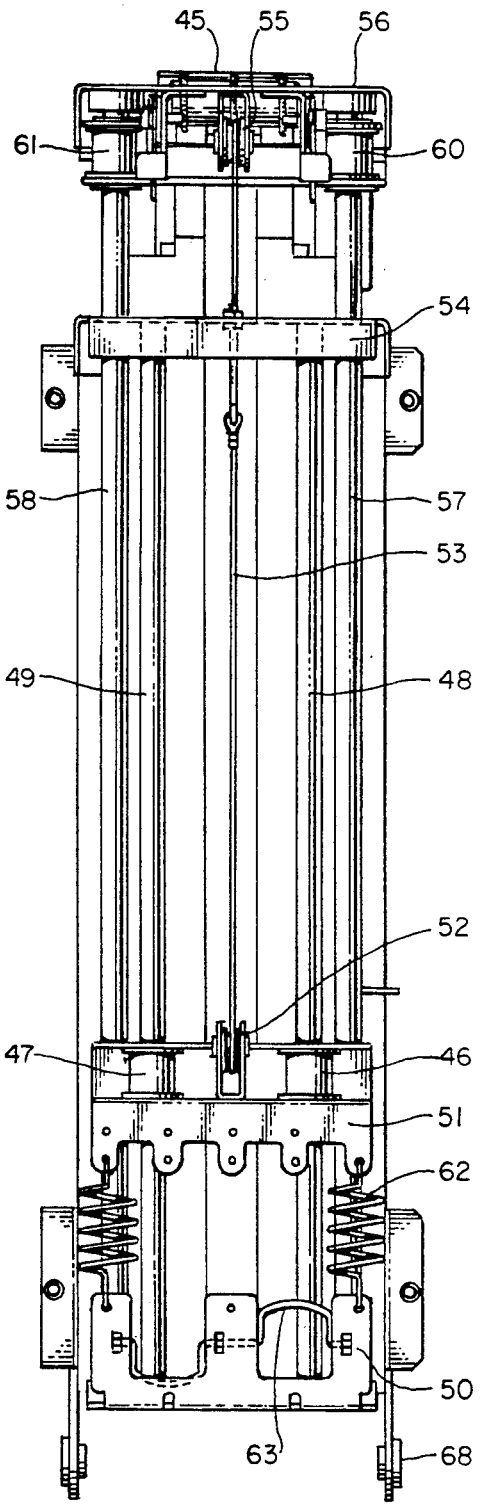
FIG. 8 is a front elevational view of the spring advancement mechanism shown in FIG. 6.

Referring now in detail in FIG. 8, it can be seen that the carriage 51 includes a plurality of lugs through which a multiplicity of springs, such as spring 62, may be placed in order to selectively adjust for biasing the platform in the upper direction. A tension adjust means is provided by a retaining means 63 that can be used to accommodate additional springs in conjunction with opposing or opposite carriage lugs. In a typical design situation, the largest spring has an enclosed height of approximately five inches and 24 inches of travel is required in the application being described. The housing which contains the brochures, pieces of literature or the like, and the springs is only 26 inches high so that a definite interference is encountered. Also, in a conventional design, a series of springs must be designed that will accommodate the full weight range of the brochures or pieces of literature while maintaining the minimum force on the dispensing mechanism rollers of 5.5 to 7 pounds.

Therefore, by employing the inventive concept, a double pulley mechanism is used which is similar to a block and tackle mechanical advantage design, is used to reduce the spring extension. As illustrated, the springs extend one-half the distance of the brochure stack which is 12 inches, while the force required to lift the brochures or pieces of literature is double. Also, a turn buckle type of adjustment is located on one of the cables for minor spring preload adjustment when various combinations of springs are employed with the double pulley mechanism, and the full weight range of the various brochures can be lifted while maintaining the recommended pressure against the roller mechanism. The total number of springs when used is 8 and the maximum number of springs used at one time is 5. The difference of springs is stored inside the housing until ready for use.

During the construction and design of dispensing apparatus, certain problems must be considered. For example, the rollers in the dispensing mechanism will only dispense a brochure when the upward force exerted by the brochures against the rollers is between 5.5 to 7 pounds. If the force is less than 5.5 pounds, indexing does not take place and the next brochure will not advance. If the force exceeds 7 pounds, either more than one brochure will be distributed or the mechanism jams. The dispenser, as shown in the drawings, is designed to accommodate a stack of brochures up to 24 inches in height. The weight of a 24 inch stack of brochures can vary between 17.1 to 35.7 pounds. Because the stack of brochures varies in height as distribution takes place, it is calculated that the brochure weight variance in inches is between 1.403 to 1.487 pounds per inch. The housing which includes the advance mechanism is 26 inches in height and 24 inches of this height is consumed by the stack of brochures. This leaves only 2 inches of space to contain a spring means that must extend 24 inches. By employing the spring means and double pulley mechanism in combination, a two to one mechanical relationship between the springs and the brochure weight is established. This allows the device to attach a series of springs to the bottom pulley via the carriage 51 and the stationary bottom, indicated by numeral 67. The springs exert a force of twice the brochure weight, plus a preload ranging between 5.5 to 7 pounds and extend ½" for each inch the brochures move. This results in the springs moving 12" as a 24" stack of brochures is distributed, which provides sufficient room for spring extension.

Another problem with conventional devices resides in employing a spring that provides the preload of 11 to 14 pounds plus 2.806 to 2.974 (double the brochure weight and preload) and extends 12". A single spring cannot be designed to accommodate this need, so the solution incorporated into the present invention was to design three different springs and, by mixing the type of spring and quantity used, the entire range of forces can be obtained. This means when brochures of a different weight are added, the spring mix must be adjusted.

In order to load brochures or pieces of literature on top of the platform 45, the entire advance mechanism is swung downwardly from the external housing about pivots 68. When the brochures are added, the latch 22 is released, and the advance mechanism pivots down to expose the top opening so brochures can be added. After loading, the advance mechanism unit swings up until the latch 22 holds in place with the retaining pin 23 carried on the inside of the stationary housing.

The springs, as shown in FIG. 8, may vary in height so different combinations create an attachment problem. To solve this problem, a variety of different hole locations is shown and the wire bail 63 when pivoted up can accept connection by one end of a spring. When pivoted down out of the way, a longer spring can be attached to the two holes located at the very bottom. The proper spring combination provides the critical force and the eye bolt on the cable provides the fine tension adjustment. When brochures are added, the lower pulley carriage moves up the shafts or rods and the carriage for the platform moves down and the tension springs are extended.

In view of the foregoing, it is seen that the advance mechanism of the present invention provides a novel means for biasing a stack of literature pieces or brochures into contact with the surfaces of the dispensing rollers with sufficient pressure to permit dispensing without jamming. Also, the length of spring extension is controlled by the unique double pulley arrangement as well as provision for selection of number of springs to be employed between the carriage 51 and the base 67.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A stand for dispensing of pieces of literature from a stack comprising the combination of:

an elongated cabinet having an internal storage compartment;

a movable carriage within said storage compartment;

a platform fixed to said carriage so as to move as a unit therewith within said storage compartment;

a stack of literature pieces disposed on said platform having the topmost piece of literature partially exposed in a preparatory position for removal from said cabinet;

dispensing mechanism carried on said cabinet in frictional engagement with the uppermost piece of literature whereby manual advancement of said topmost piece of literature from said cabinet moves a secondmost piece of literature underlying said topmost piece into said preparatory position;

advancement mechanism including resilient means operably coupled between said carriage and said cabinet normally biasing and urging said stack of literature towards said dispensing mechanism;

said cabinet having a dispensing slot immediately ahead of said dispensing mechanism through which a portion of said topmost piece of literature is exposed when in said preparatory position;

said resilient means includes at least one expansion spring having its opposite ends detachably connected to said carriage and said cabinet respectively.

2. The invention as defined in claim 1 wherein:

said resilient means applies a load pressure against said dispensing mechanism within a minimum range of 4 to 8 pounds.

3. The invention as defined in claim 2 wherein:

said resilient means includes at least two to a maximum number of five expandable springs.

4. The invention as defined in claim 3 wherein:

said minimum range of 4 to 8 pounds constituting a preload and said stack of literature pieces has a given weight;

said applied load to said dispensing mechanism equals twice said given brochure weight plus said preload pressure within said minimum range.

5. The invention as defined in claim 3 including:

a traveller movably supported on said cabinet;

said resilient means coupled between said cabinet and said traveller;

a mechanical advantage means operably connecting said traveller with said carriage.

6. The invention as defined in claim 5 wherein:

said mechanical advantage means includes a double pulley arrangement including a first pulley carried on said traveller and a second pulley carried on said carriage;

a pulley cable trained about said first and second pulleys and having opposite ends secured to said cabinet and said carriage respectively.

7. The invention as defined in claim 6 including:

a first pair of spaced-apart rods movably supporting said traveller so as to travel vertically in a first rectilinear and reciprocating path; and a second pair of spaced-apart rods of longer length than said first pair of rods movably supporting said carriage and platform in a second rectilinear and reciprocating path in fixed spaced-apart parallel relationship to said first rectilinear and reciprocating path.

8. The invention as defined in claim 7 including:

bushings movably mounting said traveller to said first pair of rods and mounting said carriage to said second pair of rods.

9. The invention as defined in claim 8 wherein:

said resilient means maintains a minimum force on said dispensing mechanism via said stack of literature within a range of 5.5 to 7 pounds.

* * * * *